US008851183B2

(12) United States Patent
Yates et al.

(10) Patent No.: US 8,851,183 B2
(45) Date of Patent: Oct. 7, 2014

(54) CASING HANGER LOCKDOWN SLIP RING

(76) Inventors: Chad Eric Yates, Houston, TX (US); David L. Ford, Houston, TX (US); Daniel Caleb Benson, Spring, TX (US)

( * ) Notice: Subject to any disclaimer, the term of this patent is extended or adjusted under 35 U.S.C. 154(b) by 577 days.

(21) Appl. No.: 13/172,537

(22) Filed: Jun. 29, 2011

(65) Prior Publication Data

US 2012/0241162 A1 Sep. 27, 2012

Related U.S. Application Data

(60) Provisional application No. 61/467,184, filed on Mar. 24, 2011.

(51) Int. Cl.
*E21B 7/12* (2006.01)
*E21B 33/043* (2006.01)

(52) U.S. Cl.
CPC ..... *E21B 33/043* (2013.01)
USPC ..... 166/348; 166/360; 166/368

(58) Field of Classification Search
CPC ..... E21B 19/16; E21B 23/00; E21B 33/043; E21B 17/02; E21B 33/03
USPC ..... 166/348, 360, 368, 378–380, 382, 166/75.14
See application file for complete search history.

(56) References Cited

U.S. PATENT DOCUMENTS 4,131,287 A * 12/1978 Gunderson et al. ..... 277/328
4,714,111 A * 12/1987 Brammer ..... 166/182
4,823,871 A * 4/1989 McEver et al. ..... 166/182
4,949,786 A * 8/1990 Eckert et al. ..... 166/208
4,960,172 A * 10/1990 Nelson ..... 166/208
5,060,724 A * 10/1991 Brammer et al. ..... 166/208
5,174,376 A * 12/1992 Singeetham ..... 166/208
5,307,879 A 5/1994 Kent
5,456,314 A * 10/1995 Boehm et al. ..... 166/208
6,367,558 B1 * 4/2002 Borak, Jr. ..... 166/387
6,510,895 B1 * 1/2003 Koleilat et al. ..... 166/208
7,559,366 B2 * 7/2009 Hunter et al. ..... 166/217
7,743,832 B2 * 6/2010 Shaw et al. ..... 166/338
7,762,319 B2 7/2010 Nelson
8,186,426 B2 * 5/2012 Nelson ..... 166/88.3

(Continued)

FOREIGN PATENT DOCUMENTS

EP 2189620 A1 5/2010
GB 2305680 A 4/1997

OTHER PUBLICATIONS

Search Report from corresponding GB Application No. GB1205078.7 dated Jul. 4, 2012.

*Primary Examiner* — Matthew Buck
*Assistant Examiner* — Aaron Lembo

(57) ABSTRACT

A seal seals an annulus in a subsea assembly between a wellhead and a casing hanger landed on a shoulder within a bore of the wellhead. The seal includes a casing hanger seal ring disposed within the annulus. The seal ring engaged with an inner diameter surface of the wellhead, and engaged with an outer diameter surface of the casing hanger so that the seal ring prevents flow through the annulus. A lockdown slip ring is secured to a lower end of the seal ring so that, when the seal ring is energized, the lockdown slip ring engages a substantially smooth inner diameter surface portion of the wellhead and a substantially smooth outer diameter surface portion of the casing hanger to limit upwards axial movement of the casing hanger.

20 Claims, 4 Drawing Sheets

(56) References Cited

U.S. PATENT DOCUMENTS 8,322,428 B2 * 12/2012 Jennings ..... 166/338
2010/0116489 A1 5/2010 Nelson
2010/0147533 A1 6/2010 Nelson
2011/0005774 A1 1/2011 Sinnott et al.
2013/0248199 A1 * 9/2013 Gette et al. ..... 166/368

* cited by examiner

CASING HANGER LOCKDOWN SLIP RING

This application claims priority to and the benefit of co-pending U.S. Provisional Application No. 61/467,184, filed on Mar. 24, 2011, entitled "Casing Hanger Lockdown Slip Ring," which application is hereby incorporated herein by reference.

BACKGROUND OF THE INVENTION

1. Field of the Invention

The present invention relates in general to wellhead casing hangers and, in particular, to a casing hanger lockdown slip ring that converts axial loads into radial loads.

2. Brief Description of Related Art

Seals are used between inner and outer wellhead tubular members to contain internal well pressure. The inner wellhead member may be a tubing hanger that supports a string of tubing extending into the well for the flow of production fluid. The tubing hanger lands in an outer wellhead member, which may be a wellhead housing, a Christmas tree, or a tubing head. A seal or packoff seals between the tubing hanger and the outer wellhead member. Alternately, the inner wellhead member might be a casing hanger located in a wellhead housing and secured to a string of casing extending into the well. A seal or packoff seals between the casing hanger and the wellhead housing.

A variety of seals of this nature have been employed in the prior art. Prior art seals include elastomeric and partially metal and elastomeric rings. Prior art seal rings made entirely of metal for forming metal-to-metal seals are also employed. The seals may be set by a running tool, or they may be set in response to the weight of the string of casing or tubing. One type of prior art metal-to-metal seal has inner and outer walls separated by a conical slot. An energizing ring is pushed into the slot to deform the inner and outer walls apart into sealing engagement with the inner and outer wellhead members. The energizing ring is a solid wedge-shaped member. The deformation of the inner and outer walls exceeds the yield strength of the material of the seal ring, making the deformation permanent.

Thermal growth between the casing or tubing and the wellhead may occur, particularly with wellheads located at the surface, rather than subsea. The well fluid flowing upward through the tubing heats the string of tubing, and to a lesser degree the surrounding casing. The temperature increase may cause the tubing hanger and/or casing hanger to move axially a slight amount relative to the outer wellhead member or each other. During the heat up transient, the tubing hanger and/or casing hanger can also move radially due to temperature differences between components and the different rates of thermal expansion from which the component materials are constructed. If the seal has been set as a result of a wedging action where an axial displacement of energizing rings induces a radial movement of the seal against its mating surfaces, then sealing forces may be reduced if there is movement in the axial direction due to pressure or thermal effects. A reduction in axial force on the energizing ring results in a reduction in the radial inward and outward forces on the inner and outer walls of the seal ring, which may cause the seal to leak. A loss of radial loading between the seal and its mating surfaces due to thermal transients may also cause the seal to leak.

Prior art apparatuses that attempt to overcome the problems caused by axial movement of the casing hanger or tubing hanger include lockdown seals. Lockdown seals require formation of a groove in the landing sub or wellhead during the manufacturing process. After the wellhead and landing sub are positioned within the wellbore, the lockdown seal is run to the location of the landing sub where a ring of the lockdown seal either expands or contracts into the groove formed into the wellhead or landing sub, respectively. Unfortunately, the groove often fills with debris prior to run-in of the lockdown seal. The debris prevents engagement of the ring and thus, prevents no lockdown benefits of the lockdown seal result.

Lockdown seals require a significant increase in production costs. This is due in part to increased costs to modify the basic wellhead or landing sub to include the lock ring groove. In addition, the use of these devices necessitate use of specialized tools and other components to properly land and engage the lockdown seal. Furthermore, prior art lockdown seals require some clearance between the landing sub and the lockdown apparatus of the lockdown seal. This clearance allows the lockdown seal to land in the appropriate location relative to the wellhead and landing sub while also providing the necessary space for the lockdown portion of the seal to engage either the wellhead or the landing sub. The clearance also allows the landing sub to shift before the lockdown device properly engages and arrests movement of the landing sub. In such instances, the landing sub may shift axially and cause the seal to fail. Thus, there is a need for a lockdown seal that overcomes the problems in the prior art described above.

SUMMARY OF THE INVENTION

These and other problems are generally solved or circumvented, and technical advantages are generally achieved, by preferred embodiments of the present invention that provide a casing hanger lockdown slip ring, and a method for using the same.

In accordance with an embodiment of the present invention, a subsea wellhead assembly is disclosed. The subsea wellhead assembly includes a subsea wellhead defining a bore having a shoulder. The subsea wellhead assembly further includes a casing hanger landed on the shoulder within the bore of the subsea wellhead and defining an annulus between the subsea wellhead and the casing hanger. A casing hanger seal ring is disposed within the annulus. The seal ring is engaged with an inner diameter surface of the wellhead and engaged with an outer diameter surface of the casing hanger so that the seal ring prevents flow through the annulus. A lockdown slip ring is secured to a lower end of the seal ring so that, when the seal ring is energized, the lockdown slip ring engages a substantially smooth inner diameter surface portion of the wellhead and a substantially smooth outer diameter surface portion of the casing hanger to limit upwards axial movement of the casing hanger.

In accordance with another embodiment of the present invention, a seal for sealing an annulus between inner and outer tubular members, wherein the inner tubular member is landed in a bore of the outer tubular member, is disclosed. The seal includes a seal ring adapted to land in the annulus and adapted to expand radially when energized to engage an inner diameter surface of the outer tubular member and an outer diameter surface of the inner tubular member. The seal further includes a lockdown slip ring secured to a lower end of the seal ring so that, when energized, the lockdown slip ring may engage an inner diameter surface of the outer tubular member and an outer diameter surface of the inner tubular member to limit upwards axial movement of the inner tubular member. The lockdown slip ring has a neck on an upper end of the lockdown slip ring, and the neck has a groove on an outer diameter of the neck. The seal ring has a lower leg on a lower end of the seal ring, and the lower leg has a recess on an inner diameter of the lower leg. A retainer ring comprising a split ring is interposed between the neck of the lockdown slip ring and the lower leg of the seal ring so that the retainer ring is partially within the groove and partially within the recess, securing the lockdown slip ring to the seal ring.

In accordance with yet another embodiment of the present invention, a method for sealing a casing hanger to a wellhead is disclosed. The method begins by landing the casing hanger on a shoulder in the wellhead. Next, the method secures a lockdown slip ring to a lower end of a casing hanger seal and lands the casing hanger seal in an annulus between the casing hanger and the wellhead. The casing hanger seal is then energized by exerting a downward axial force on the casing hanger seal to compress the seal and the lockdown slip ring against a shoulder of the casing hanger. The downward axial force causes the lockdown slip ring to engage a substantially smooth inner diameter surface of the wellhead and a substantially smooth outer diameter surface of the casing hanger to limit upward axial movement of the casing hanger.

An advantage of a preferred embodiment is that disclosed embodiments provide a lockdown seal that seals a casing hanger to a wellhead without the need for formation of a groove in either the casing hanger or wellhead. In addition, the disclosed embodiments do not require clearance between the casing hanger and the lockdown portion of the seal in order to engage. Thus, the disclosed embodiments may provide lockdown capability that prevents axial motion of the casing hanger caused by high pressures and thermal expansion.

BRIEF DESCRIPTION OF THE DRAWINGS

So that the manner in which the features, advantages and objects of the invention, as well as others which will become apparent, are attained, and can be understood in more detail, more particular description of the invention briefly summarized above may be had by reference to the embodiments thereof which are illustrated in the appended drawings that form a part of this specification. It is to be noted, however, that the drawings illustrate only a preferred embodiment of the invention and are therefore not to be considered limiting of its scope as the invention may admit to other equally effective embodiments.

DETAILED DESCRIPTION OF THE PREFERRED EMBODIMENT

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used, indicates similar elements in alternative embodiments.

In the following discussion, numerous specific details are set forth to provide a thorough understanding of the present invention. However, it will be obvious to those skilled in the art that the present invention may be practiced without such specific details. Additionally, for the most part, details concerning well drilling, running operations, and the like have been omitted in as much as such details are not considered necessary to obtain a complete understanding of the present invention, and are considered to be within the skills of persons skilled in the relevant art.

Figure 1:
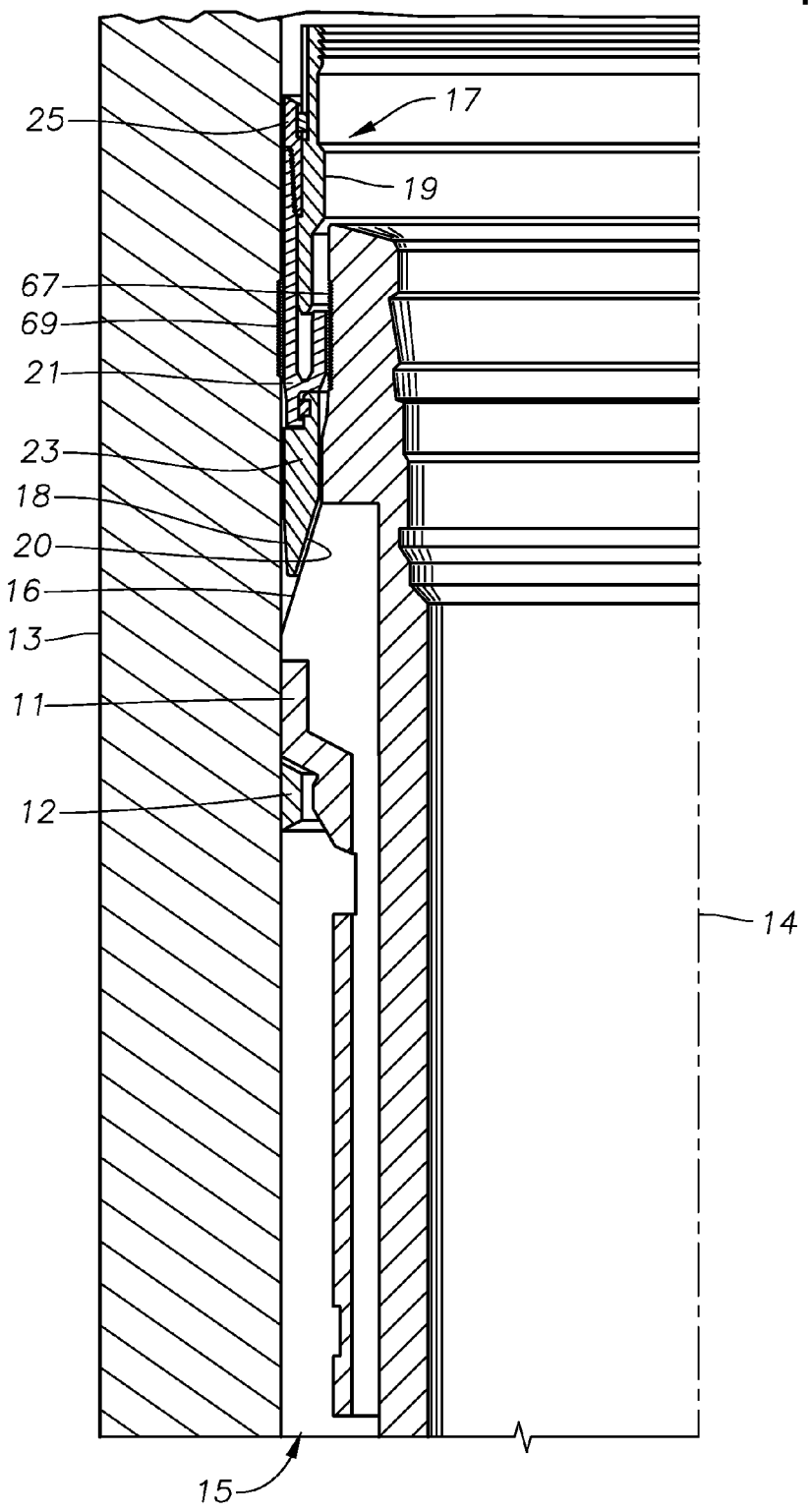
FIG. 1 is a schematic representation of a casing hanger lockdown slip ring landed in place within an annulus between a casing hanger and a wellhead.

Referring to FIG. 1, a casing hanger 11 having an axis 14 is shown disposed within a subsea wellhead 13. Generally, casing hanger 11 will land on a shoulder 12 formed in wellhead 13 to form an annulus 15 between casing hanger 11 and wellhead 13. In the illustrated embodiment, a portion of an exterior surface of casing hanger 11 contacts a portion of an interior surface of wellhead 13 at a shoulder 12. A person of ordinary skill in the art will understand that casing hanger 11 and wellhead 13 may be any inner and outer tubular members such that the inner tubular member may fit within a bore of the outer tubular member.

Figure 2:
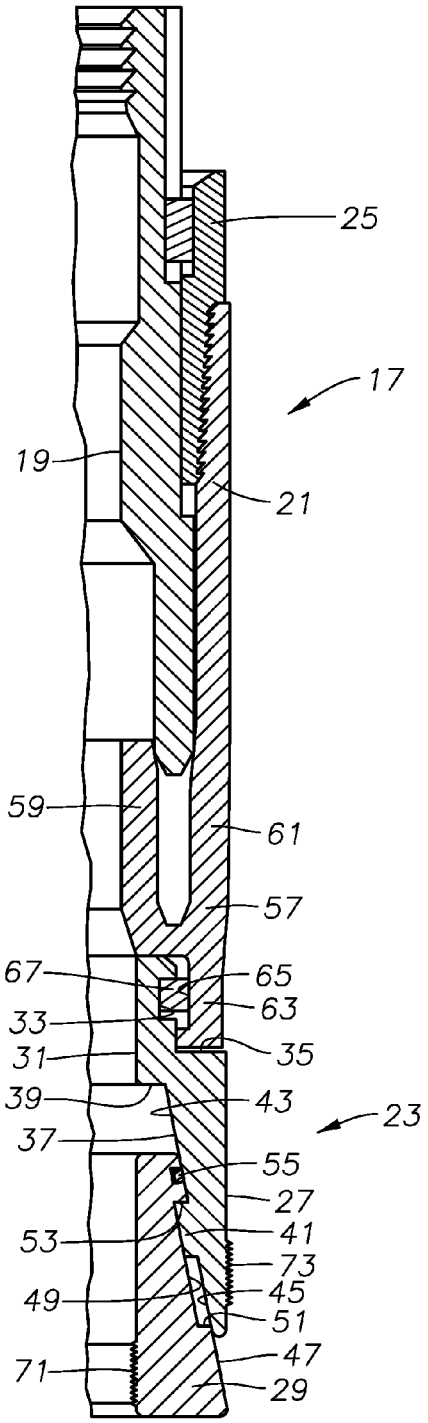
FIG. 2 is a schematic representation of an alternative lockdown slip ring.
Figure 4:
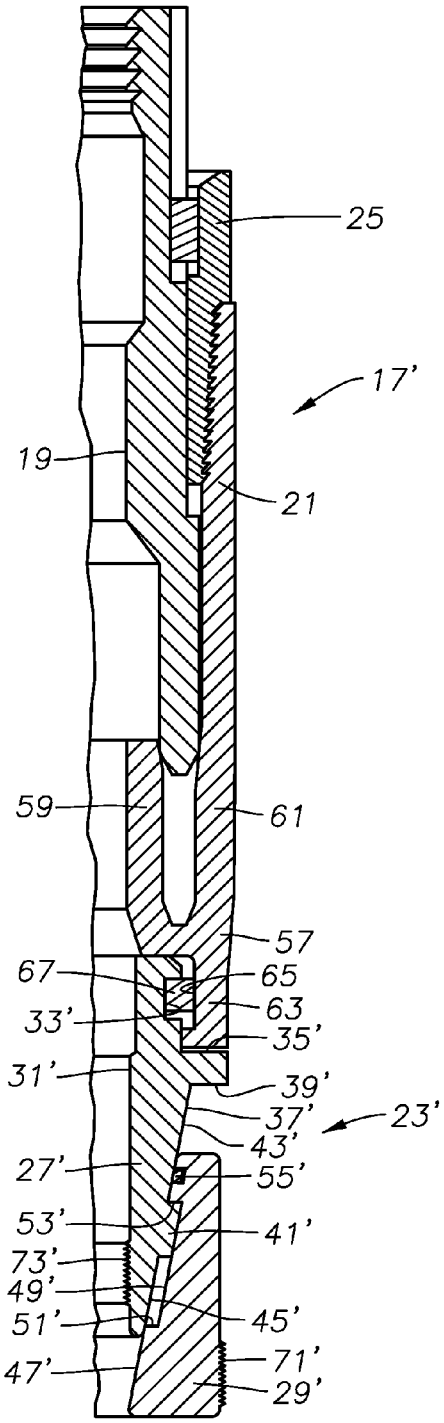
FIG. 4 is a schematic representation of an alternative lockdown slip ring.

A casing hanger seal ring 17 is interposed between casing hanger 11 and wellhead 13. Casing hanger seal ring 17 substantially fills annulus 15 between casing hanger 11 and wellhead 13, sealing annulus 15 and setting casing hanger 11 to wellhead 13. Casing hanger seal ring 17 has an energized and an unenergized position. When in the energized position, as described in more detail with respect to FIGS. 3 and 5, casing hanger seal ring 17 will seal the annulus by engaging both the inner diameter surface of wellhead 13, and the outer diameter surface of casing hanger 11. When in the unenergized position, as shown in FIGS. 2 and 4, casing hanger seal ring 17 may be run into the wellbore to land in annulus 15 between casing hanger 11 and wellhead 13, or pulled from annulus 15 between casing hanger 11 and wellhead 13. In the illustrated embodiment, casing hanger seal ring 17 includes an energizing ring 19, a seal ring 21, a lockdown slip ring 23, and a locking ring 25.

In the illustrated embodiment, lockdown slip ring 23 couples to a lower end of seal ring 21 and defines an annular protrusion that may include a taper 18 on an outer diameter at a lower end as shown in FIG. 1. Lockdown slip ring 23 has a ramped surface 20 on its inner diameter adapted to interface with an exterior tapered surface 16 of casing hanger 11 such that upward axial movement of casing hanger 11 will engage lockdown slip ring 23. Preferably, the slope of ramped surface 20 may match the slope of exterior tapered surface 16 of casing hanger 11. In the illustrated embodiment, the slope may comprise an angle of approximately 20 degrees from vertical; however, a person skilled in the art will understand that any suitable angle may be used. In the illustrated embodiment, lockdown slip ring 23 does not move axially relative to seal ring 21; however, lockdown slip ring 23 may move radially relative to seal ring 21. The surfaces of taper 18 and ramped surface 20 may have differing friction factors such that ramped surface 20 is more likely to slip than taper 18. This may be achieved in any suitable manner such as by employing wickers or teeth on the surface of taper 18, by using a variety of friction gripping coatings, or the like. A person skilled in the art will understand that both the surface of taper 18 and ramped surfaced 20 may include friction coatings, wickers, or the like.

As casing hanger 11 moves upward axially relative to wellhead 13, exterior surface profile 16 of casing hanger 11 will first abut and then exert an upward axial force on casing hanger seal 17 through the adjacent ramped surface 20 of lockdown slip ring 23. The upward axial force on lockdown slip ring 23 will cause lockdown slip ring 23 to move radially outward, engaging taper 18 with the inner diameter of wellhead 13 in response. Due to the increase frictional gripping force caused by the differing frictional forces between taper 18 and ramped surface 20, casing hanger seal 17 may not move axially in response to upward axial movement of casing hanger 11. As a consequence, upward axial movement of casing hanger 11 will be limited due to the engagement of casing hanger seal 17 with casing hanger 11.

As shown in FIG. 2, an alternate embodiment of lockdown slip ring 23 may comprise two annular rings, a coupling ring 27 and a slip ring 29. Coupling ring 27 has a protrusion 31 at an upper end that defines a retaining groove or slot 33 in an outer diameter surface of protrusion 31. Groove 33 may be an annular groove or alternatively, groove 33 may extend only partway around the outer circumference of protrusion 31. Coupling ring 27 also defines an annular upward facing shoulder 35. Upward facing shoulder 35 extends from an outer diameter of coupling ring 27 to a base of protrusion 31 such that groove 33 faces an area axially above upward facing shoulder 35. In the illustrated embodiment, upward facing shoulder 35 has a width that is approximately half the width of a cross section of coupling ring 27.

Figure 3:
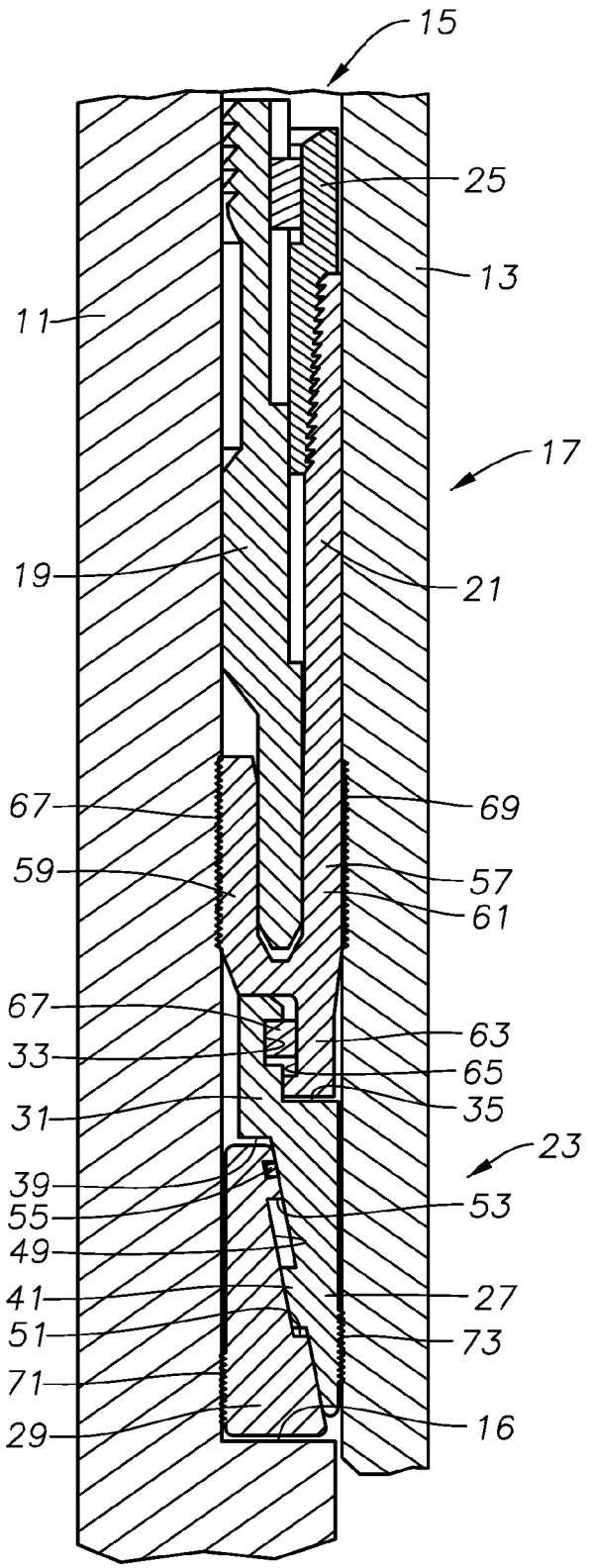
FIG. 3 is a schematic representation of the lockdown slip ring of FIG. 2 energized within an annulus between a wellhead and a casing hanger.

A lower end of coupling ring 27 has an approximately triangular shaped cross section having a substantially vertical surface forming the outer diameter of coupling ring 27 extending from the lower end to upward facing shoulder 35, and a ramped surface 37 extending from the lower end of coupling ring 27 to a downward facing shoulder 39 axially beneath protrusion 31. A lower end of the exterior diameter surface of coupling ring 27 may include wickers 73 that are adapted to engage the inner diameter surface of wellhead 13 as shown in FIG. 3. Wickers 73 may comprise gripping teeth or the like. Referring to FIG. 2, downward facing shoulder 39 extends from an inner diameter of coupling ring 27 to a base of ramped surface 37. A slip ring limiter 41 may protrude from a portion of ramped surface 37 to define annular upper and lower coupling ring channels 43, 45, respectively. In the illustrated embodiment, slip ring limiter 41 is positioned approximately halfway between a lower end of coupling ring 27 and downward facing shoulder 39.

Slip ring 29 comprises a substantially wedged shaped object having an inner diameter that is substantially vertical, and an outer diameter comprising a ramped surface 47 adapted to mate with ramped surface 37 of coupling ring 27. A lower end of the inner diameter surface may include wickers 71 adapted to engage an exterior diameter surface of casing hanger 11 or, alternatively exterior surface profile 16 of casing hanger 11. Wickers 71 may comprise gripping teeth or the like. A slip ring recess 49 is formed in ramped surface 47 and extends inward from ramped surface 47. Slip ring recess 49 is an annular recess adapted to receive slip ring limiter 41. In the illustrated embodiment, a height of slip ring recess 49 is greater than a height of slip limiter 41, allowing slip ring limiter 41 to move axially within slip ring recess 49. As shown, slip ring 29 may slide axially relative to coupling ring 27 through slip ring recess 49. Slip limiter 41 will limit axial movement of slip ring 29 through contact with an upward facing shoulder 51 of slip ring recess 49 and a downward facing shoulder 53 of slip ring recess 49. Slip ring 29 may secure to coupling ring 27 with a shear element, such as shear retaining pin 55. Shear retaining pin 55 will prevent axial movement of slip ring 29 relative to coupling ring 27 during running of casing hanger 17.

In the illustrated embodiment, seal ring 21 comprises an annular member having an approximately U-shaped cross section 57 with seal ring legs 59, 61 and a lower leg 63. Lower leg 63 extends past protrusion 31 of coupling ring 29 proximate to upward facing shoulder 35 of coupling ring 27. In the illustrated embodiment, lower leg 63 defines a retainer recess 65 proximate to and facing groove 33. A retainer ring 67 may be interposed between lower leg 63 of seal ring 21 and protrusion 31 of coupling ring 27 such that retainer ring 67 substantially fills groove 33. A portion of retainer ring 67 will extend into retainer recess 65, causing coupling ring 27 to move axially in response to axial movement of seal ring 21. When thus positioned, the width of the combined protrusion 31 of coupling ring 27 and lower leg 63 of seal ring 21 is approximately equivalent to a width of seal ring 21 across the base of U-shaped cross section 57. Retainer ring 67 may be any suitable ring such as a split ring or the like.

Energizing ring 19 comprises a ring having an axially lower end slightly larger than the slot defined between seal ring legs 59, 61 of seal ring 21. Energizing ring 19 has an upper end adapted to be releasably coupled to a running tool so that the running tool may run casing hanger seal 17 to the location shown in FIG. 1, and then operate energizing ring 19 to energize casing hanger seal 17.

As described in more detail below, a running tool will apply an axial force to energizing ring 19, forcing energizing ring 19 axially into seal ring 21, providing an interference fit that will press seal ring legs 61, 59 of seal ring 21 into adjacent wickers 67 and 69 (FIG. 1 and FIG. 3). This will seal annulus 15 between casing hanger 11 and wellhead 13 at seal ring 21. A person skilled in the art will understand that the energizing ring 19 may be energized by a running tool or the like.

Referring now to FIG. 3, casing hanger seal 17 is run to land and set as shown in a typical running operation. While running into annulus 15, the elements of casing hanger seal 17 are as illustrated in FIG. 2. An axial force is then applied to energizing ring 19, such as with a running tool. Energizing ring 19 moves downward axially in response such that an end of energizing ring 19 applies a corresponding downward axial force to upper surfaces of seal ring legs 59, 61. Continued application of downward axial force to energizing ring 19 pushes a lower end of slip ring 29 into contact with exterior surface profile 16 of casing hanger 11 near location 12 of FIG. 1. Referring to FIG. 3, lockdown slip ring 23 is then compressed between seal ring 21 and the exterior surface of casing hanger 11 at upward facing shoulder 16 by energizing ring 19, causing shear pin 55 to shear. Coupling ring 27 will then move axially downward through slip recess 49. Eventually, a lower surface of slip retainer 41 may land against upward facing shoulder 51 of slip ring 29 as shown in FIG. 3.

Downward movement of coupling ring 27 through slip recess 49 causes slip ring 29 to move radially into engagement with casing hanger 11 in response. As slip ring 29 moves radially into casing hanger 11, wickers 71 will grip the surface of casing hanger 11, holding slip ring 29 in engagement with casing hanger 11. Similarly, wickers 73 will engage an inner diameter surface of wellhead 13, holding coupling ring 27 in engagement with wellhead 13.

Further downward axial movement of energizing ring 19 causes an end of energizing ring 19 to insert into the slot formed by seal ring legs 59, 61. As the end of energizing ring 19 inserts into the slot, seal ring legs 59, 61 will deform radially into engagement with wickers 67, 69, respectively. The inner diameter surface of seal ring leg 59 will then be deformed by wickers 67 of casing hanger 11, and the outer diameter surface of seal ring leg 61 will be deformed by wickers 69 of wellhead 13, forming a seal of annulus 15.

During subsea operation of wellhead 13, thermal expansion of casing suspended from casing hanger 11, or fluid pressure within annulus 15 beneath casing hanger seal 17 may place an upward axial load on casing hanger 11. As casing hanger 11 attempts to move axially upward relative to wellhead housing 13 in response to such a load, casing hanger seal 17 will counteract this movement in the following manner. As casing hanger seal 11 moves upward, slip ring 29 will move axially upward as a result of the gripping engagement of wickers 71 with the exterior surface of casing hanger 11. This will cause slip ring 29 to slide further up the mating ramped surfaces 47 and 37 relative to coupling ring 27. As shown in FIG. 3, this movement will cause slip ring 29 to move radially inward resulting in an increase of the width of casing hanger seal 17 at slip ring 29 and coupling ring 27. Slip ring 29 and coupling ring 27 will now be radially adjacent within annulus 15 as shown in FIG. 3. This radial movement will more tightly grip casing hanger 11 to wellhead 13 through casing hanger seal 17. Continued upward movement of slip ring 29 is prevented when upward facing shoulder 51 of slip ring 29 lands on slip limiter 41, thereby preventing further upward axial movement of casing hanger 11 and increasing the strength of the seal within annulus 15.

Referring now to FIG. 4, there is shown another alternative casing hanger seal 17'. Casing hanger seal 17' includes the components of casing hanger seal 17 of FIG. 2, modified as described below. As shown in FIG. 4, casing hanger seal 17' includes energizing ring 19, seal ring 21, and locking ring 25 of FIG. 2. Energizing ring 19, seal ring 21, and locking ring 25 of FIG. 4 are positioned and operate as described above with respect to FIG. 2 and FIG. 3.

As shown in FIG. 4, casing hanger seal 17' also includes lockdown slip ring 23'. Lockdown slip ring 23' couples to a lower end of seal ring 21. Lockdown slip ring 23' may comprise two annular rings, a coupling ring 27' and a slip ring 29'. Coupling ring 27' has a protrusion 31' at an upper end that defines a retaining groove or slot 33' in an outer diameter surface of protrusion 31'. Groove 33' may be an annular groove or alternatively, groove 33' may extend only partway around the outer circumference of protrusion 31'. Coupling ring 27' also defines an annular upward facing shoulder 35'. Upward facing shoulder 35' extends from an outer diameter of coupling ring 27' to a base of protrusion 31'. In the illustrated embodiment, upward facing shoulder 35' has a width that is approximately half the width of a cross section of coupling ring 27'.

Figure 5:
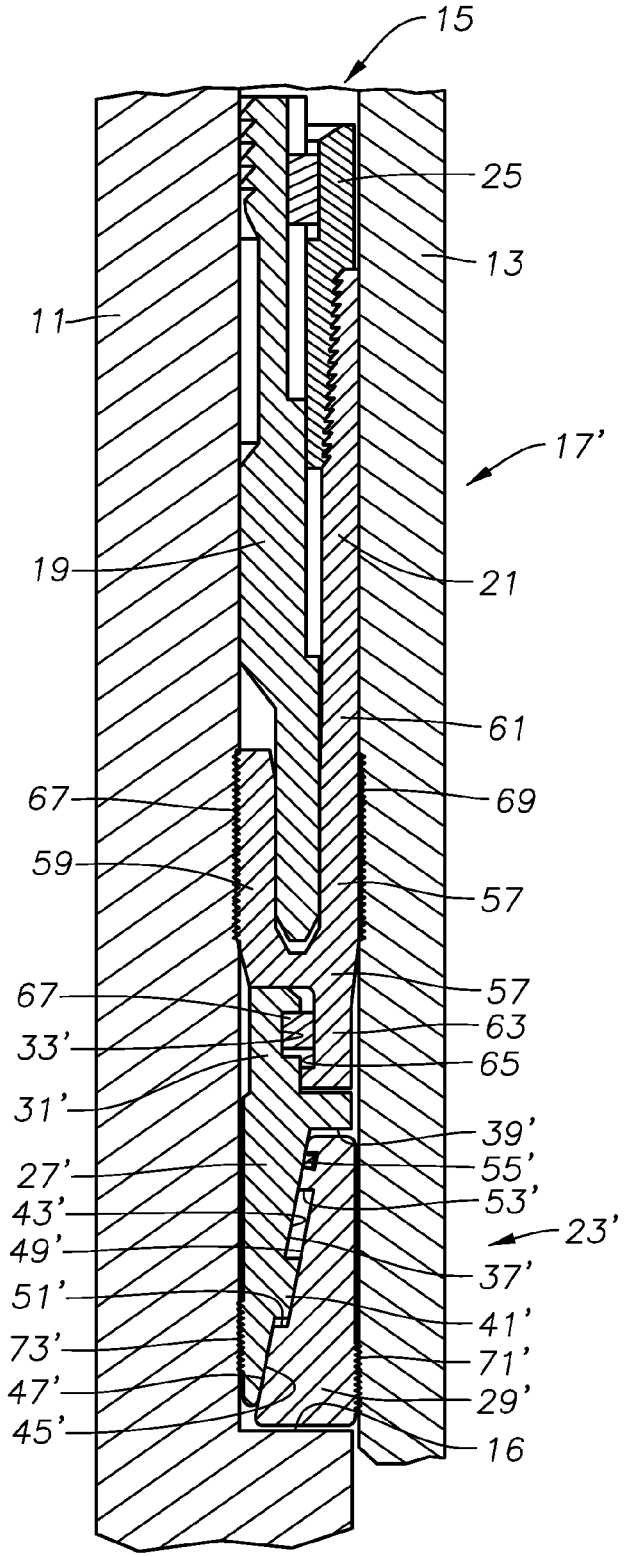
FIG. 5 is a schematic representation of the lockdown slip ring of FIG. 4 energized within an annulus between a wellhead and a casing hanger.

A lower end of coupling ring 27' has an approximately triangular shaped cross section having a substantially vertical surface forming the inner diameter of coupling ring 27'. The substantially vertical surface extends from the lower end to a top of protrusion 31'. The lower end of coupling ring 27' has a ramped surface 37' extending from the lower end of coupling ring 27' to a downward facing shoulder 39' axially beneath upward facing shoulder 35'. A lower end of the exterior diameter surface of coupling ring 27' may include wickers 73' that are adapted to engage the inner diameter surface of wellhead 13 as shown in FIG. 5. Wickers 73' may comprise gripping teeth or the like. Referring to FIG. 4, downward facing shoulder 39' extends from an outer diameter of coupling ring 27' to a base of ramped surface 37'. A slip ring limiter 41' may protrude from a portion of ramped surface 37' to define upper and lower coupling ring channels 43', 45', respectively. In the illustrated embodiment, slip ring limiter 41' is positioned approximately halfway between a lower end of coupling ring 27' and downward facing shoulder 39'.

Slip ring 29' comprises a substantially wedged shaped object having an outer diameter that is substantially vertical, and an inner diameter comprising a ramped surface 47' adapted to mate with ramped surface 37' of coupling ring 27'. A lower end of the inner diameter surface may include wickers 71' adapted to engage an exterior diameter surface of casing hanger 11 or, alternatively an upward facing shoulder 16 of casing hanger 11. Wickers 71' may comprise gripping teeth or the like. A slip ring recess 49' is formed in ramped surface 47' and extends inward from ramped surface 47'. Slip ring recess 49' is an annular recess adapted to receive slip ring limiter 41'. As shown, slip ring 29' may slide axially relative to coupling ring 27' through slip ring recess 49'. Slip limiter 41' will limit axial movement of slip ring 29' through contact with upward facing shoulder 51' of slip ring recess 49' and downward facing shoulder 53' of slip ring recess 49'. Slip ring 29' may secure to coupling ring 27' with a shear element, such as shear retaining pin 55'. Shear retaining pin 55' will prevent axial movement of slip ring 29' relative to coupling ring 27' during running of casing hanger 17'.

In the illustrated embodiment, lower leg 63 of seal ring 21 extends past protrusion 31' of coupling ring 29' proximate to upward facing shoulder 35' of coupling ring 27'. As described above, lower leg 63 defines an retainer recess 65 proximate to and facing groove 33'. A retainer ring 67 may be interposed between lower leg 63 of seal ring 21 and protrusion 31' of coupling ring 27' such that retainer ring 67 substantially fills groove 33'. A portion of retainer ring 67 will extend into retainer recess 65 causing coupling ring 27 to move axially in response to axial movement of seal ring 21.

Referring now to FIG. 5, casing hanger seal 17' is run to land and set as shown. While running into annulus 15, the elements of casing hanger seal 17' are as illustrated in FIG. 4. An axial force is then applied to energizing ring 19, such as with a running tool. Energizing ring 19 moves downward axially in response such that an end of energizing ring 19 contacts upper surfaces of seal ring legs 59, 61. Continued application of downward axial force to energizing ring 19 pushes a lower end of slip ring 29' into contact with exterior surface profile 16 of casing hanger 11 near shoulder 12 of FIG. 1. As shown in FIG. 3, lockdown slip ring 23' is then compressed between seal ring 21 and exterior surface profile 16 of casing hanger 11 by energizing ring 19 causing shear pin 55' to shear. Coupling ring 27' will then move axially downward through slip recess 49' in response, eventually landing at a lower surface of slip retainer 41' against upward facing shoulder 51' of slip ring 29'.

Downward movement of coupling ring 27' through slip recess 49' causes slip ring 29' to move radially into engagement with wellhead 13 in response. As slip ring 29' moves radially into wellhead 13, wickers 71' will grip the surface of wellhead 13, holding slip ring 29' in engagement with wellhead 13. Similarly, wickers 73' will engage an outer diameter surface of casing hanger 11, holding coupling ring 29' in engagement with wellhead 13.

Further downward axial movement of energizing ring 19 causes an end of energizing ring 19 to insert into the slot formed by seal ring legs 59, 61. As the end of energizing ring 19 inserts into the slot, seal ring legs 59, 61 will deform radially outward into engagement with wickers 67, 69, respectively. The inner diameter surface of seal ring leg 59 will then be deformed by wickers 67 of casing hanger 11, and the outer diameter surface of seal ring leg 61 will be deformed by wickers 69 of wellhead 13, forming a seal of annulus 15.

During subsea operation of wellhead 13, thermal expansion of casing suspended from casing hanger 11, or fluid pressure within annulus 15 beneath casing hanger seal 17' may place an upward axial load on casing hanger 11. However, the increased radial width of casing hanger seal 17' caused by the movement of slip ring 29' along the ramped surface 47' will act as a type of friction lock, exerting a radial force on casing hanger 11. As a result, as casing hanger 11 attempts to move axially upward relative to wellhead housing 13 in response to such a load, the friction lock caused by the radial expansion of casing hanger seal 17' will counteract this movement, preventing movement of casing hanger 11. The additional width of lockdown slip ring 23', caused by the movement of slip ring 29' along ramped surface 47' during setting, increases the radial force exerted between wellhead 13 and casing hanger 11. This will then prevent upward axial movement of casing hanger 11.

Accordingly, the disclosed embodiments provide a metal seal that can land and seal an annulus between a casing hanger and a wellhead without the need of a landing shoulder or dog recess machined within the wellhead. Thus, there is no concern that debris may have landed on the shoulder or filled the dog recess that would prevent setting of the seal. In addition, the disclosed embodiments provide a metal seal that increases in strength as pressure loading within the annulus beneath the seal increases. Furthermore, the metal seal disclosed herein eliminates the need for the seal to tolerate some axial shift before sealing; instead the seal preloads against its own load shoulder and prevents displacement of the casing hanger found in some cyclic loading, allowing the seal to operate for more cycles than in prior art designs.

It is understood that the present invention may take many forms and embodiments. Accordingly, several variations may be made in the foregoing without departing from the spirit or scope of the invention. Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

What is claimed is:

1. A subsea wellhead assembly comprising:

a subsea wellhead defining a bore having a shoulder;

a casing hanger landed on the shoulder within the bore of the subsea wellhead and defining an annulus between the subsea wellhead and the casing hanger;

a casing hanger seal ring disposed within the annulus, engaged with an inner diameter surface of the wellhead, and engaged with an outer diameter surface of the casing hanger so that the seal ring prevents flow through the annulus; and a lockdown slip ring secured to a lower end of the seal ring so that, when the seal ring is energized, the lockdown slip ring engages a substantially smooth generally axially straight inner diameter surface portion of the wellhead and a substantially smooth generally axially straight outer diameter surface portion of the casing hanger to limit upwards axial movement of the casing hanger.

2. The subsea wellhead assembly of claim 1, wherein a retaining ring is interposed between the lockdown slip ring and the seal ring to secure the lockdown slip ring to the seal ring.

3. The subsea wellhead assembly of claim 1, wherein the lockdown slip ring comprises:

an annular protrusion having a taper adjacent the smooth surface portion of the inner diameter of the subsea wellhead;

the annular protrusion having a ramped surface radially opposite the taper, the ramped surface adapted to interface with a shoulder of the substantially smooth outer diameter of the casing hanger so that upward axial movement of the casing hanger will cause the shoulder to engage the ramped surface and displace the annular protrusion radially outward so that the taper engages the smooth surface of the inner diameter of the subsea wellhead; and wherein surfaces of the taper and the ramped surface of the annular protrusion define wickers adapted to engage the substantially smooth surfaces of the casing hanger and subsea wellhead.

4. The subsea wellhead assembly of claim 1, wherein the lockdown slip ring comprises:

a coupling ring secured to a lower end of the seal ring, the coupling ring having a ramped surface;

a slip ring having a ramped surface abutting the ramped surface of the coupling ring, the slip ring held in a first position relative to the coupling ring by a shear element; and the slip ring secured to the coupling ring so that axial movement of the slip ring causing shear of the shear element will cause the slip ring to slide along the ramped surface of the coupling ring, increasing the radial width of the lockdown slip ring.

5. The subsea wellhead assembly of claim 4, wherein the coupling ring ramped surface faces the outer diameter surface of the casing hanger.

6. The subsea wellhead assembly of claim 4, wherein the coupling ring ramped surface faces the inner diameter surface of the wellhead.

7. The subsea wellhead assembly of claim 4, wherein:

the ramped surface of the coupling ring faces downward and outward; and the ramped surface of the slip ring faces upward and inward.

8. The subsea wellhead assembly of claim 1, wherein the lockdown slip ring comprises:

a coupling ring secured to a lower end of the seal ring, the coupling ring having a ramped surface, the coupling ring further comprising wickers on a surface parallel to an axis of the coupling ring opposite the ramped surface so that the wickers engage at least one of the inner diameter of the subsea wellhead and the outer diameter of the casing hanger; and a slip ring having a ramped surface abutting the ramped surface of the coupling ring, the slip ring further comprising wickers on a surface parallel to an axis of the slip ring opposite the surface slidingly engaged with the coupling ring so that the wickers engage at least one of the outer diameter of the casing hanger and the inner diameter of the subsea wellhead.

9. The subsea wellhead assembly of claim 2, further comprising:

a neck on an upper end of the lockdown slip ring, the neck having a groove on an outer diameter of the neck;

a lower leg on a lower end of the seal ring, the lower leg having a recess on an inner diameter of the lower leg; and wherein the retainer ring comprises a split ring interposed between the neck of the lockdown slip ring and the lower leg of the seal ring so that the retainer ring is partially within the groove and partially within the recess, securing the lockdown slip ring to the seal ring.

10. A seal for sealing an annulus between inner and outer tubular members, wherein the inner tubular member is landed in a bore of the outer tubular member, the seal comprising:

a seal ring adapted to land in the annulus and adapted to expand radially when energized to engage an inner diameter surface of the outer tubular member and an outer diameter surface of the inner tubular member;

a lockdown slip ring secured to a lower end of the seal ring so that, when energized, the lockdown slip ring may engage a substantially smooth generally axially straight inner diameter surface of the outer tubular member and a substantially smooth generally axially straight outer diameter surface of the inner tubular member to limit upwards axial movement of the inner tubular member;

the lockdown slip ring having a neck on an upper end of the lockdown slip ring, the neck having a groove on an outer diameter of the neck;

the seal ring having a lower leg on a lower end of the seal ring, the lower leg having a recess on an inner diameter of the lower leg; and wherein a retainer ring comprises a split ring interposed between the neck of the lockdown slip ring and the lower leg of the seal ring so that the retainer ring is partially within the groove and partially within the recess, securing the lockdown slip ring to the seal ring.

11. The seal of claim 10, wherein the lockdown slip ring comprises:

an annular protrusion having a taper adjacent the inner diameter of the outer tubular member; and the annular protrusion having a ramped surface radially opposite the taper, the ramped surface adapted to interface with a shoulder on the outer diameter of the inner tubular member so that upward axial movement of the inner tubular member will cause the shoulder to engage the ramped surface and displace the annular protrusion radially outward so that the taper engages the inner diameter of the outer tubular member.

12. The seal of claim 11, wherein the surface of the taper has a first friction factor, and the ramped surface has a second friction factor.

13. The seal of claim 11, wherein surfaces of the taper and the ramped surface of the annular protrusion define wickers adapted to engage the surfaces of the inner and outer tubular members.

14. The seal of claim 10, wherein the lockdown slip ring comprises:

a coupling ring secured to a lower end of the seal ring, the coupling ring having a ramped surface;

a slip ring having a ramped surface abutting the ramped surface of the coupling ring, the slip ring held in a first position relative to the coupling ring by a shear element; and the slip ring secured to the coupling ring so that axial movement of the slip ring causing shear of the shear element will cause the slip ring to slide along the ramped surface of the coupling ring, increasing the radial width of the lockdown slip ring.

15. The seal of claim 14, wherein the coupling ring ramped surface is adapted to face the outer diameter surface of the inner tubular member.

16. The seal of claim 14, wherein the coupling ring ramped surface is adapted to face the inner diameter surface of the outer tubular member.

17. The seal of claim 14, wherein:

the coupling ring further comprising wickers on a surface parallel to an axis of the coupling ring opposite the ramped surface so that the wickers engage at least one of the inner diameter of the outer tubular member and the outer diameter of the inner tubular member; and the slip ring further comprising wickers on a surface parallel to an axis of the slip ring opposite the surface slidingly engaged with the coupling ring so that the wickers engage at least one of the outer diameter of the inner tubular member and the inner diameter of the outer tubular member.

18. A method for sealing a casing hanger to a wellhead, comprising:

(a) landing the casing hanger on a shoulder in the wellhead;

(b) securing a lockdown slip ring to a lower end of a casing hanger seal and landing the casing hanger seal in an annulus between the casing hanger and the wellhead;

(c) energizing the casing hanger seal by exerting a downward axial force on the casing hanger seal to compress the seal and the lockdown slip ring against a shoulder of the casing hanger; and (d) wherein the downward axial force causes the lockdown slip ring to engage a substantially smooth generally axially straight inner diameter surface of the wellhead and a substantially smooth generally axially straight outer diameter surface of the casing hanger to limit upward axial movement of the casing hanger.

19. The method of claim 18, further comprising wickers on the inner and outer diameters of the lockdown slip ring, wherein, in the event the casing hanger moves axially upward, step (d) comprises moving the lockdown slip ring of the casing hanger seal radially into tighter engagement with the inner diameter surface of the wellhead by engaging the wickers on the inner and outer diameter surfaces of the lockdown slip ring with the casing hanger and wellhead.

20. The method of claim 18, wherein, the lockdown slip ring comprises a coupling ring and a slip ring that are moveable axially between contracted and extended positions:

wherein step (a) comprises securing the coupling ring and the slip ring in the extended position with a shear element; and wherein step (d) comprises shearing the shear element and causing the coupling ring and slip ring to move toward the contracted position.

* * * * *

UNITED STATES PATENT AND TRADEMARK OFFICE

CERTIFICATE OF CORRECTION

PATENT NO. : 8,851,183 B2
APPLICATION NO. : 13/172537
DATED : October 7, 2014
INVENTOR(S) : Chad Eric Yates et al.

It is certified that error appears in the above-identified patent and that said Letters Patent is hereby corrected as shown below:

On the Title Page - Second Column - after "Assistant Examiner - Aaron Lembo", insert:

Item --(74) Attorney, Agent, or Firm - Bracewell & Giuliani LLP--

Signed and Sealed this
Twenty-seventh Day of January, 2015

Michelle K. Lee

Michelle K. Lee
*Deputy Director of the United States Patent and Trademark Office*